US006782700B1

(12) United States Patent
Unger et al.

(10) Patent No.: US 6,782,700 B1
(45) Date of Patent: Aug. 31, 2004

(54) TRANSIENT TEMPERATURE CONTROL SYSTEM AND METHOD FOR PREVENTING DESTRUCTIVE COLLISIONS IN FREE PISTON MACHINES

(75) Inventors: Reuven Z-M Unger, Athens, OH (US); Ezekiel S. Holliday, Belpre, OH (US)

(73) Assignee: Sunpower, Inc., Athens, OH (US)

( * ) Notice: Subject to any disclaimer, the term of this patent is extended or adjusted under 35 U.S.C. 154(b) by 0 days.

(21) Appl. No.: 10/785,319

(22) Filed: Feb. 24, 2004

(51) Int. Cl.[7] ..... F01B 29/10
(52) U.S. Cl. ..... 60/517; 60/524
(58) Field of Search ..... 60/517, 518, 523, 60/524

(56) References Cited

U.S. PATENT DOCUMENTS

RE30,176 E 12/1979 Beale
4,881,372 A * 11/1989 Naito ..... 60/521
5,813,235 A * 9/1998 Peterson ..... 62/6
6,094,912 A * 8/2000 Williford ..... 60/520
6,330,800 B1 * 12/2001 Price et al. ..... 62/6
6,446,444 B1 * 9/2002 Chase et al. ..... 62/6
6,536,207 B1 * 3/2003 Kamen et al. ..... 60/39.6

* cited by examiner

*Primary Examiner*—Hoang Nguyen
(74) *Attorney, Agent, or Firm*—Frank H. Foster; Kremblas, Foster, Phillips & Pollick

(57) ABSTRACT

The free piston cooler transient temperature control system of the present invention eliminates collisions during the transient cool-down period in a free piston cooler upon start-up. The transient temperature control system incorporates a free piston cooler, having a cold head and a warm end, a cold head temperature sensor, a relational interface, and a temperature controller. The cold head temperature sensor senses the temperature of the cold head and generates a temperature signal. The relational interface is in communication with the temperature signal and contains a predetermined relationship between the cold head temperature and a maximum piston stroke during the transient cool-down temperature range. The relational interface generates a transient range maximum allowable stroke signal from the temperature signal and the predetermined relationship. The temperature controller is in communication with the relational interface and limits the piston stroke during the transient cool-down temperature range to prevent collisions.

12 Claims, 3 Drawing Sheets

Fig. 3

| Cold End Temperature (° K) | Max. Piston Stroke (mm) | Min. Piston Stroke (mm) |
|---|---|---|
| Above 282 | 4.688 | 4 |
| 282 | 5.313 | 4 |
| 275 | 5.469 | 4 |
| 264 | 5.938 | 4 |
| 240 | 6.250 | 4 |
| 200 | 6.5 | 4 |
| Below 200 | 6.5 | 4 |

TRANSIENT TEMPERATURE CONTROL SYSTEM AND METHOD FOR PREVENTING DESTRUCTIVE COLLISIONS IN FREE PISTON MACHINES

BACKGROUND OF THE INVENTION

1. Field of the Invention

The present invention relates to the field of free piston machine control systems, and more particularly relates to a transient temperature range control system for avoiding damaging collisions within a free piston cooler when operating in the cool-down transient temperature range between start-up and steady state operation.

2. Description of the Related Art

The Stirling engine was invented in the early 1800's but was not used as a refrigeration cycle until 1834 when John Hershel used a closed cycle Stirling engine to make ice. The basic concepts of the free piston engine and the free piston cooler were invented in the 1960's by William T. Beale and are shown in U.S. Pat. No. Re30,176. Many advances, including those in bearing technology, low clearance seals, and regenerative materials, have vastly improved the reliability and efficiency of free piston machines.

The free piston cooler is essentially a pressure vessel enclosing a piston and displacer reciprocating in one or, more typically, separate, coaxial cylinders. The piston is driven in linear reciprocation and alternately compresses and expands a working gas to create a pressure wave as a function of time. The displacer is driven in reciprocation by the pressure wave acting upon a net pressure differential area and alternately moves or shuttles a major portion of the working gas between a cold head, where thermal energy may be extracted from a cold head environment, and a warm end, where heat is rejected to a warm end environment. The piston and displacer are phased so that the piston expands the working gas when the major part of the working gas is in the cold head and compresses the working gas when the major part of the working gas in at he warm end. Thus, heat is absorbed at the cold head during expansion of the working gas and heat is rejected at the warm end during compression of the working gas. There are, of course, various alternative drive arrangements for moving the piston and displacer in the desired reciprocation at the desired phase relation.

The piston is free because no mechanical linkage confines the piston to a fixed path of reciprocation. The free piston is typically driven in reciprocation by a linear electric motor. Typically, in order to maximize the efficient use of available drive power, free piston machines are driven at their frequency of mechanical resonance. Because the piston is unconfined in a free piston machine, the amplitude of reciprocation, also referred to as the stroke, is a function of piston drive force and varies under the influence of changing operating conditions. Consequently, the piston, as well as any other reciprocating structures, can collide at either end of the piston stroke with physical structures at the end of the cylinder.

In particular, in such freely reciprocating machines the amplitude and frequency of reciprocation are a function of inertia, damping, and spring and driving forces. Therefore, these machines share the common feature that, when they are overdriven or underdamped, the reciprocating parts can acquire an amplitude of reciprocation that exceeds the internal geometric limits of the space available for the motion of the reciprocating parts. If the amplitude of reciprocation is allowed to increase beyond these limits, the reciprocating parts will collide repeatedly with stationary structures, or even with other reciprocating parts. Such collisions are obviously undesirable because they may damage the machine.

Of particular concern, with respect to the present invention, is the initial, transient cool-down period when the Stirling cooler first begins operation. The period of time from the start of operation of a free piston cooler until the cold head reaches a desired set point temperature is the transient cool-down period. The initial temperature of the cold head during the transient cool-down period is often room temperature, approximately 300° K, and the desired set point temperature at which the cooler will eventually operate is often extremely cold, perhaps as low as approximately 77° K, or colder. As the working gas transitions from the warm initial cold head temperature to the cold set point cold head temperature, the properties of the working gas change greatly, thereby affecting the machine operating dynamics during the transient cool-down period. Specifically, as the working fluid cools it becomes more dense and viscous and, therefore, the damping of the reciprocating displacer and piston increases accordingly as the operating temperature decreases. For example, the density and viscosity of the working fluid may increase by a factor of 4.

This density change creates a problem at start up during the transient cool-down period because the control system is typically a feedback control system designed to control piston stroke under normal operating conditions, i.e. at the lower operating temperature, where damping from the working gas is greater. Consequently, at start up the cooling demand is maximum, the control system tends to drive the piston at the drive force and power which would be appropriate for the lower operating temperature but the damping is less during start up than at the operating temperature for which the control system was designed. Therefore, unless other provision is made, the piston will be overdriven at the warmer, temperatures where damping is less and collisions can result.

One prior art solution is to under power the piston drive during the transient cool-down period to assure that collisions do not occur. The piston drive amplitude is gradually or incrementally increased, sometimes manually, until, over a sufficient time period, the operating temperature is reached.

However, the problem with prior art solutions is that, not only is it desirable to avoid such collisions during the transient cool-down period, but also it is desirable to reach the desired operating temperature as quickly and efficiently as possible. Therefore, for all the intermediate temperatures throughout the entire transient cool-down period it is desirable to operate at the maximum stroke that will not result in collisions in order to pump heat from the cold head at the maximum rate of heat transfer and thereby bring the cooler to its steady state operating temperature as soon as possible.

Numerous prior art control systems have been developed to prevent collisions from occurring within free piston machines after they reach their normal operating temperature. The driving force or power applied to the piston to force it in its maximum reciprocating linear oscillation is initially much less than that required when the colder set point operating temperature is reached, in part because of the increase of the working gas density as the machine cools down. Accordingly, conventional feedback control systems designed to prevent collisions when operating at steady state temperatures, i.e. not in the transient cool-down period, would allow too much driving force to be applied to the piston during the transient cool-down period, thereby promoting collisions during that period. Such control systems have failed to address the unique conditions presented upon start-up of the machine. Such prior art control systems are generally only effective once the machine has reached steady state temperature operation.

To accomplish a maximization of stroke over the temperature range as the temperature of the cold head decreases, the drive must be progressively increased as the temperature is reduced and therefore, the limit must be progressively increased. A difficulty of doing this in an automated control system arises because there is no known algorithm or relationship applicable to each machine for relating the cold head temperature to maximum piston drive power.

For purposes of describing the invention, the term "cylinder end structure" is used to refer to a physical body at either end of the linear path of piston reciprocation with which the piston, or structures linked to and oscillating with the piston, can collide if the piston's amplitude or oscillation increases excessively. The term "piston drive" or "drive" is the driving force or power applied to the piston to force it in its reciprocating, linear oscillation. Since piston amplitude is an increasing function of piston drive, an increase or decrease in piston drive, respectively increases or decreases the amplitude of piston oscillation if other parameters remain constant or undergo only variations which do not completely negate the change in piston drive.

Therefore, in summary, workers in the free piston Stirling machine industry have recognized the need for including, either within the control system or as auxiliary structures, a means for preventing free piston machines from damaging or destroying themselves by internal collisions. Prior art free piston machine control systems have focused on the steady state operation of the machine. During this steady state operation, if an initial collision is not recognized and the control system does not make the proper corrections, the magnitude of the collisions can increase with each cycle, often leading to irreparable damage. Such conventional control systems have not attempted to maximize piston stroke, and thereby minimize the time until the machine reaches steady state operating conditions, during the transient cool-down period and at the transient temperature conditions which occur after a free piston machine begins operation and while it works toward steady state operation. Control systems adapted to handle the unique conditions experienced in the transient temperature range are particularly important for free piston coolers.

It is, therefore, an object and feature of the present invention to provide a control system for a free piston cooler, which, under all operating conditions including transient start up conditions, maximizes piston stroke and therefore minimizes the transient time period, while avoiding collision of the piston, or component structures reciprocating with the piston, against cylinder end structures.

BRIEF SUMMARY OF THE INVENTION

In one of the many preferable configurations, the transient temperature control system and method of the present invention controls a free piston cooler, having a cold head and a warm end and includes a cold head temperature sensor, a relational interface, and a temperature controller. The cold head temperature sensor senses the temperature of the cold head and generates a temperature signal. The relational interface is in communication with the temperature signal and contains a predetermined relationship between the cold head temperature and a maximum piston stroke during the transient cool-down temperature range. The relational interface generates a transient range maximum allowable stroke signal from the temperature signal and the predetermined relationship. The temperature controller preferably also controls the stroke of the piston while the cold head operates at a steady state cold head temperature. The temperature controller is in communication with the relational interface and is capable of receiving the transient range maximum allowable stroke signal and using it in limiting the piston stroke to prevent collisions within the cooler during the transient cool-down temperature range.

The relational interface contains the predetermined relationship between the cold head temperature and the maximum piston stroke during the transient cool-down temperature range. The predetermined relationship may be determined via computer modeling of the free piston cooler or through experimentation. The relationship may be established by operating the free piston cooler during the transient cool-down temperature range and recording the stroke that results in a collision, referred to as a collision stroke, between cooler components. A stroke reduction factor is then applied to the collision stroke, to provide a safety margin, to produce a transient controlled stroke used in generating the transient range maximum allowable stroke signal. The predetermined relationship is often effectively stored as a plurality of data, which may be expressed in tabular form, or as an algorithm.

BRIEF DESCRIPTION OF THE SEVERAL VIEWS OF THE DRAWINGS

Without limiting the scope of the present invention as claimed below and referring now to the drawings and figures:

FIG. 3 is a table showing an example of the data values stored in the relational interface of the present invention.

DETAILED DESCRIPTION OF THE INVENTION

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
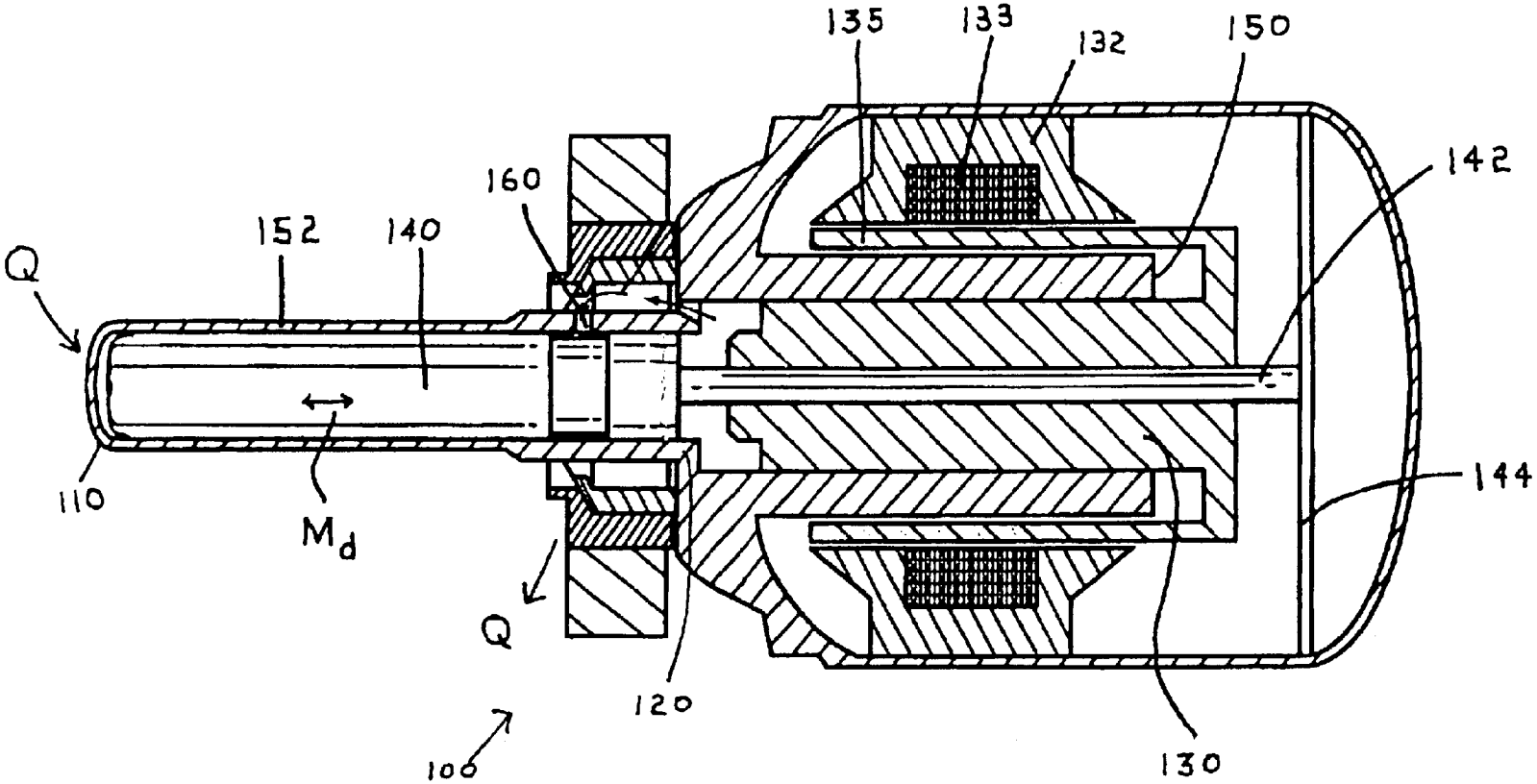
FIG. 1 is a partial cross section view, not to scale, of an embodiment of a free piston cooler that is well known in the prior art.
Figure 2:
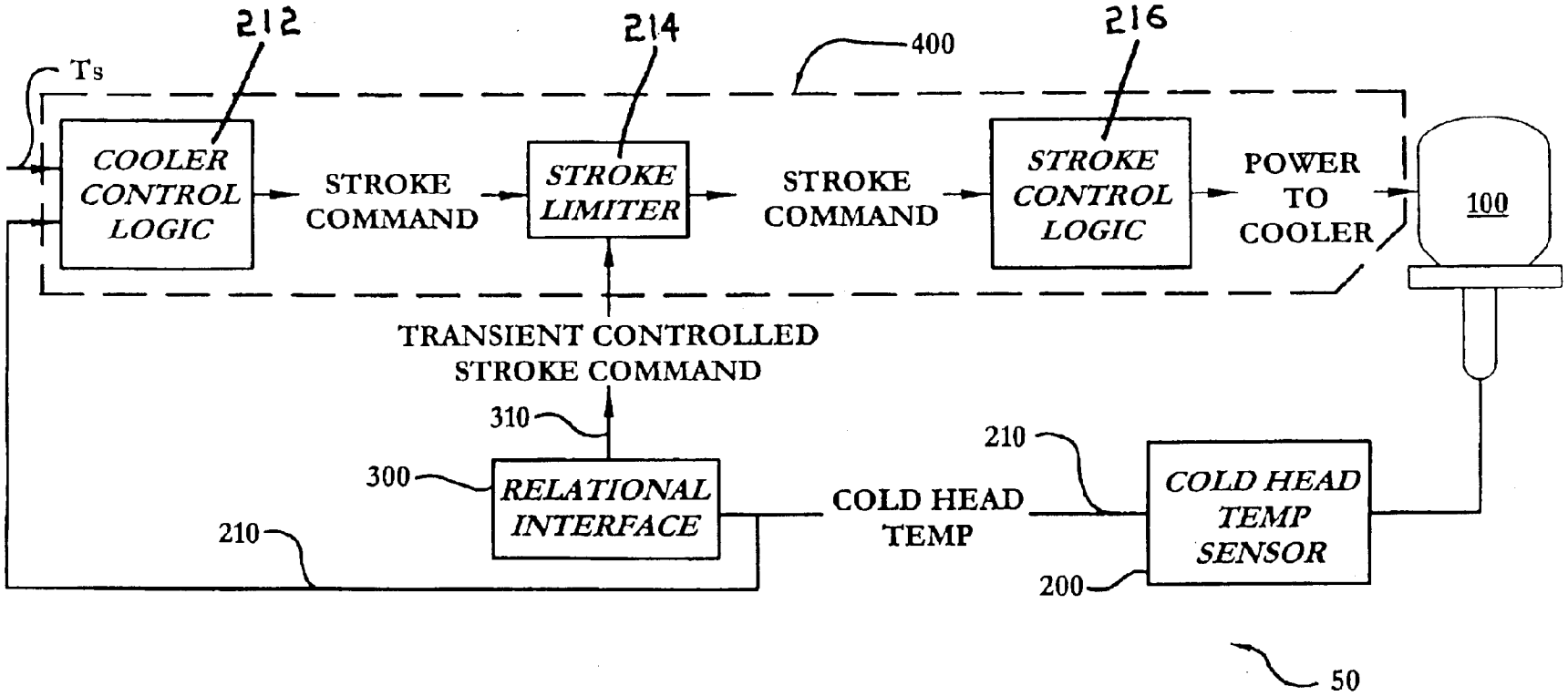
FIG. 2 is a schematic of the transient temperature control system of the present invention.

With reference generally now to FIG. 1 and FIG. 2, in one of the many preferable configurations, the temperature control system 50 incorporates a free piston cooler 100, having a cold head 110 and a warm end 120, a cold head temperature sensor 200, a relational interface 300, and a temperature controller 400. The temperature sensor 200 may be in thermal connection directly to the cold head 110 or connected to or within the insulated enclosure which conventionally surrounds the cold head and contains one or more objects to be cooled.

The free piston cooler 100 of FIG. 1 includes a piston 130, driven by a piston driver 132, reciprocating within a cylinder 150, and a displacer 140 attached to a displacer rod 142, slidingly passing through the piston 130 and attached to a displacer spring 144. The displacer 140 reciprocates within the cylinder 152, indicated by motion indicator Md, between the cold head 110 and the warm end 120. The preferred piston driver 132 is a linear motor having an armature winding 133 which drives magnets 135 which are fixed to the piston 130. A regenerator is contained within the displacer. This arrangement is described in more detail in U.S. Pat. No. 6,446,336 which is herein incorporated by reference.

During operation of the free piston cooler 100, the piston driver 132, typically an electric linear motor, moves the piston 130 in the directions of motion indicated by Mp. The movement of the piston 130 from a first position to a second position, where the direction of travel reverses, defines a stroke, also referred to as amplitude. The piston stroke of the free piston cooler 100 is variable, is a function of the amplitude of the electromagnetic field generated by armature winding 133 and is variably controlled by the control system to satisfy any number of objectives. Efficient operation is accomplished in the steady state by operating the piston at a stroke which maintains the temperature of the objects being cooled at a set point temperature.

In operation, a working fluid, generally helium, is transported, compressed, and expanded by the combined movement of the piston 130 and the displacer 140. As previously mentioned, the movement of the piston 130 is effected by the piston driver 132. The motion of the displacer 140 is the result of many combined actions including, but not limited to, the pressure wave resulting from changes in the working fluid pressure created by the movement of the piston 130, damping effects in the free piston cooler 100 introduced by the working gas density and friction, the displacer spring 144, and other components. The movement of the displacer 140, indicated by Md, shuttles the working fluid between the cold head 110 and the warm end 120, generally through a working fluid passage 160 and a regenerator contained within the displacer. The regenerator consists of an energy storage medium to and from which the working fluid may transfer energy as it cycles from the cold head 110 to the warm end 120, and back again. Modem regenerators may incorporate pieces of fine porous metal and prevent unnecessary heat loss and improve efficiency. Heat, indicated by Q, is absorbed at the cold head 110 during expansion of the working fluid and heat, Q, is rejected at the warm end 120 during compression of the working fluid. Heat exchangers are generally attached to the cold bead 110 and the warm end 120 to improve the transfer of thermal energy to, and away from, the free piston cooler 100.

The free motion of the piston 130 in the free piston cooler 100 is both a beneficial attribute and a source of potential problems. Free piston machines are subject to collisions between the piston 130 and the displacer 140 and of either with other internal components of the free piston cooler 100, such as cylinder end structures, often resulting in damage. As the technology has advanced, numerous control systems have been introduced to minimize the destructive collisions.

The transient temperature control system 50 and method of the present invention accounts for the unique characteristics of the transient cool-down temperature range, thereby eliminating destructive collisions and permitting the free piston cooler 100 to operate at the maximum safe stroke to achieve rapid cool-down. The embodiment of the invention illustrated in FIG. 2, includes a conventional feedback control loop for controlling the piston drive and therefore the piston amplitude during steady state operation in a conventional manner. The control system 50 includes the cold head temperature sensor 200 to provide a temperature feedback signal, and the temperature controller 400. The cold head temperature sensor 200 senses the temperature of the cold head 110 and generates a temperature signal 210. This temperature signal 210 is applied to the temperature controller 400. The temperature controller 400 has cooler control logic 212 to which the temperature signal 210 is applied for use in the conventional feedback control loop to control the temperature of the cooler 100 during steady state operation. The stroke command signal output from the cooler control logic 212 is applied to a stroke limiter 214 which, during steady state operation, limits the stroke command signal to confine it to a stroke which is appropriate for steady state operation. The stroke command output from the stroke limiter 212 is then applied to conventional stroke control logic 216 which control the drive power and force applied to the piston drive 132.

Additionally, for purposes of the invention in controlling the piston stroke during the transient cool-down period, the control system also includes a relational interface 300 in communication with the temperature signal 210 to receive the temperature data. The relational interface 300 contains a stored, predetermined relationship between the cold head temperature and a maximum piston stroke during the transient cool-down temperature range. The relational interface 300 generates a transient range maximum allowable stroke signal 310 from the temperature signal 210 and the predetermined relationship. The temperature controller 400 is in communication with the relational interface 300 and receives the transient range maximum allowable stroke signal 310 and limits the piston stroke to the stroke it receives from the interface 300 to prevent collisions within the cooler during the transient cool-down temperature range.

The cold head temperature sensor 200 may be of virtually any temperature sensing technology that can accurately sense temperature in the transient temperature cool-down range. In fact, the cold head temperature sensor 200 is preferably a sensor used by the temperature controller 400 for steady state operation, and does not have to be a separate and unique sensor. Sensors suitable for such operation include diode type sensors and resistance temperature detector type sensors.

The relational interface 300 contains the predetermined relationship between the cold head temperature and the maximum piston stroke during the transient cool-down temperature range. Although the predetermined relationship might be determined via computer modeling of the free piston cooler 100, it is determined more effectively through experimentation. In one embodiment, the predetermined relationship is stored electronically in a memory device. Additionally, the predetermined relationship is often effectively stored as a plurality of data. The plurality of data may be expressed in tabular form, possibly in a database. Alternatively the data may be expressed as an algorithm, such as a series approximating a plot of the tabular data.

In the embodiment wherein the predetermined relationship is experimentally determined, the relationship may be established by operating the free piston cooler 100 during the transient cool-down temperature range, manually controlling the piston stroke and recording the stroke that results in a collision, referred to as a collision stroke, between cooler components. This process may be repeated for any number of temperatures within the transient cool-down temperature range. For example, a transient cool-down temperature range that begins with the first operating temperature of approximately 300° K and the set point operating temperature of 70° K may have experimental data collected at 10° K intervals over the entire range resulting in 24 pairs of temperature and collision stroke values. A stroke reduction factor is then applied to the collision stroke, to provide a safety margin, to produce a transient controlled stroke prior to generating the transient range maximum allowable stroke signal 310. As one with skill in the art will recognize, such experimentally collected data may also be configured as an algorithm, such as by using a mathematical series to approximate a curve generated by the collected data.

The temperature controller 400 receives the transient range maximum allowable stroke signal 310 for use in practicing the invention. The temperature controller 400 may be virtually any of a number of known control systems designed to control the operation of a free piston cooler 100 and prevent destructive collisions therein. One such temperature controller 400 is shown schematically in FIG. 2. In this particular embodiment, the temperature controller 400 consists of the cooler control logic device, stroke limiter, and stroke control logic devices connected to form a feedback control system as described above. The cooler control logic device 212 typically receives a set point operating temperature Ts and a measured operating temperature, and generates a stroke command. The stroke command is applied to the stroke limiter 214. The stroke limiter may reduce the value of the stroke based upon any number of occurrences typically associated with a collision between components of the free piston cooler. One method for detecting collisions within free piston coolers has been to acoustically sense collisions and reduce the stroke command by a predetermined value. Alternatively, stroke limiters have also relied upon velocity and acceleration detectors to detect collisions by detecting a high rate of piston deceleration, which exceeds piston deceleration during normal machine operation. Further, stroke limiters have also simply incorporated the use of a limit switch to detect destructive collisions. Next, the stroke control logic device receives the stroke command from the stroke limiter and associates it with a level of power to transfer to the cooler, typically to the piston driver 132, or electric linear motor.

The temperature controller 400 prevents collisions during the transient cool-down temperature range by receiving a separate input, reflective of the transient conditions, that may in essence override the temperature controller's steady state stroke command. This override signal is the transient range maximum allowable stroke signal 310 generated by the relational interface 300. The temperature controller 400 then limits the stroke command so as not to exceed the transient controlled stroke value, from the predetermined relationship, for any given cold head temperature during the transient cool-down temperature range. As such, the temperature controller 400 is capable of preventing collisions during the transient cool-down temperature range as well as the later period of steady state temperature operation.

FIG. 3 is a table illustrating a representative example of the data which is stored in the relational database of the present invention for an embodiment of the invention. The maximum piston stroke values represent the piston stroke limits which are input to the stroke limiter 214. Each of the data input to the stroke limiter is a value which represents the illustrated stroke limit which is input for the illustrated temperature shown in the table. Because the temperature controller 400 is designed to control the cooler at normal operating temperature, the stroke dimension stated in the table represents data for limiting the piston to the stated stroke dimensions at steady state operating temperature. Consequently, data from the relational database which limits-the stroke to a particular dimension at steady state temperature, will allow a greater stroke at a higher, cool-down period temperature because there is less damping. Therefore, the actual piston stroke at the temperatures shown in the table may all be identical, but the stroke limitation signal is changed to greater stroke limitations as the cooler cools down and damping increases. In other words, as the cooler cools down and damping increases, the stroke limitation is increased but the actual stroke itself can be maintained at a constant maximum as cool down occurs.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

What is claimed is:

1. A transient temperature control system for preventing collisions during a transient cool-down temperature range of a free piston cooler from a first operating temperature of a cold head to a set point operating temperature, the cooler having a piston reciprocating in linear oscillation within a cylinder at a variable stroke, the system comprising:

(a) a cold head temperature sensor for sensing the temperature of the cold head and generating a temperature signal;

(b) a relational interface in communication with the temperature signal and containing a predetermined relationship between the cold head temperature and a maximum piston stroke during the transient cool-down temperature range, the relational interface generating a transient range maximum allowable stroke signal from the temperature signal and the predetermined relationship; and (c) a temperature controller in communication with the relational interface, capable of receiving the transient range maximum allowable stroke signal and limiting the stroke to prevent collisions within the cooler during the transient cool-down temperature range, and capable of controlling the stroke of the piston while the cold head operates at approximately a steady state cold head temperature.

2. The control system in accordance with claim 1, wherein the predetermined relationship between the cold head temperature and the stroke comprises a plurality of stored data experimentally determined by operating the cooler during the transient cool-down temperature range, and recording the stroke resulting in collision at a plurality of cold head temperatures and generating a transient controlled stroke by applying a stroke reduction factor to the collision stroke.

3. The control system in accordance with claim 2, wherein the plurality of stored data are resident in a table form for reference by the relational interface in generating the transient range maximum allowable stroke signal.

4. The control system in accordance with claim 2, wherein the plurality of stored data are resident as a stored algorithm for reference by the relational interface in generating the transient range maximum allowable stroke signal.

5. A method for preventing collisions during a transient cool-down temperature range of a free piston cooler from a first operating temperature of a cold head to a set point operating temperature, the cooler having a piston reciprocating in linear oscillation within a cylinder at a variable stroke, the method comprising:

(a) sensing the temperature of the cold head and generating a temperature signal;

(b) generating a transient range maximum allowable stroke signal in response to the temperature signal and a predetermined relationship between the cold head temperature and a maximum piston stroke during the transient cool-down temperature range; and (c) limiting the stroke of the piston during the transient cool-down temperature range, to prevent collisions within the cooler, in response to the transient range maximum allowable stroke signal.

6. The method in accordance with claim 5, further including the step of experimentally developing the predetermined relationship between the cold head temperature and the stroke by operating the cooler during the transient cool-down temperature range, and recording the stroke resulting in collision at a plurality of cold head temperatures and generating a transient controlled stroke by applying a stroke reduction factor to collision stroke.

7. The method in accordance with claim 6, further including the step of referencing an electronic database, having the predetermined relationship between the cold head temperature and the stroke, when generating the transient range maximum allowable stroke signal.

8. The method in accordance with claim 6, further including the step of referencing an algorithm, having the predetermined relationship between the cold head temperature and the stroke, when generating the transient range maximum allowable stroke signal.

9. An apparatus for preventing collisions during a transient cool-down temperature range of a free piston cooler from a first operating temperature of a cold head to a set point operating temperature, the cooler having a piston reciprocating in linear oscillation within a cylinder at a variable stroke, the apparatus comprising:

(a) a means for sensing the temperature of the cold head and generating a temperature signal;

(b) a means for generating a transient range maximum allowable stroke signal from the temperature signal and a predetermined relationship between the cold head temperature and a maximum piston stroke during the transient cool-down temperature range; and (c) a means for controlling the stroke of the piston during the transient cool-down temperature range, to prevent collisions within the cooler, from the transient range maximum allowable stroke signal, and controlling the stroke of the piston during approximately steady state cold head temperature conditions to prevent collisions within the cooler.

10. The apparatus in accordance with claim 9, wherein the predetermined relationship between the cold head temperature and the stroke comprises a plurality of stored data experimentally determined by operating the cooler during the transient cool-down temperature range, and recording the stroke resulting in collision at a plurality of cold head temperatures and generating a transient controlled stroke by applying a stroke reduction factor to the collision stroke.

11. The apparatus in accordance with claim 10, wherein the plurality of stored data are resident in a table form for reference by the generating means in generating the transient range maximum allowable stroke signal.

12. The control system in accordance with claim 10, wherein the plurality of stored data are resident as a stored algorithm for reference by the generating means in generating the transient range maximum allowable stroke signal.

* * * * *